US008234744B2

(12) United States Patent
Seng et al.

(10) Patent No.: US 8,234,744 B2
(45) Date of Patent: Aug. 7, 2012

(54) BRISTLE HOLDER FOR A BRUSH

(75) Inventors: Juergen Seng, Kelkheim (DE); Michael Kloeppel-Riech, Friedberg (DE); Katja Honnefeller, Friedrichsdorf (DE); Sven Beutner, Frankfurt am Main (DE); Olaf Soerensen, Mainz (DE); Armin Schwarz-Hartmann, Wendelsheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/177,673

(22) Filed: Jul. 7, 2011

(65) Prior Publication Data

US 2011/0296640 A1 Dec. 8, 2011

Related U.S. Application Data

(63) Continuation of application No. PCT/IB2010/051446, filed on Apr. 1, 2010.

(30) Foreign Application Priority Data

Apr. 3, 2009 (EP) ..... 09004948

(51) Int. Cl.
*A46B 7/04* (2006.01)

(52) U.S. Cl. ..... 15/176.1; 15/176.4; 15/176.5; 15/176.6; 15/202

(58) Field of Classification Search ..... 15/176.1–176.6, 15/202

See application file for complete search history.

(56) References Cited

U.S. PATENT DOCUMENTS

| | | | | | |
|---|---|---|---|---|---|
| 993,617 | A | * | 5/1911 | Pokorney | 15/176.5 |
| 1,683,530 | A | * | 9/1928 | Cosby | 15/176.5 |
| 1,750,500 | A | * | 3/1930 | Weisz | 15/176.4 |
| 1,908,510 | A | * | 5/1933 | Dodson | 15/176.4 |
| 1,939,001 | A | * | 12/1933 | Doll | 15/176.1 |
| 2,228,754 | A | * | 1/1941 | Cosby | 15/176.4 |
| 2,319,028 | A | * | 5/1943 | Arena | 15/176.3 |
| 3,167,799 | A | * | 2/1965 | McKinley | 15/176.4 |
| 3,271,805 | A | * | 9/1966 | Sawyer | 15/176.1 |
| 4,797,966 | A | * | 1/1989 | Fong | 15/186 |
| 6,216,306 | B1 | * | 4/2001 | Esterson et al. | 15/111 |
| 2005/0051187 | A1 | | 3/2005 | Koke | |

FOREIGN PATENT DOCUMENTS

| | | | |
|---|---|---|---|
| DE | 2651730 | | 6/1977 |
| GB | 330573 | | 6/1930 |
| JP | 2002-165641 | * | 6/2002 |
| JP | 2007-296221 | * | 11/2007 |

* cited by examiner

*Primary Examiner* — Mark Spisich
(74) *Attorney, Agent, or Firm* — Jeffrey V Bamber; Kim W Zerby

(57) ABSTRACT

The present invention relates to a brush and a bristle holder. The invention relates in particular to a bristle holder for a brush, the bristle holder having a frame, a bristle anchoring means, and a back part, the back part having a first end area adjacent to the handle part of a connectable brush and a second end area adjacent to the brush end, the first end area supporting at least one first connecting element and the second end area supporting at least one positioning element and at least one holding element. The invention furthermore relates to a brush with and for a bristle holder of the described type.

9 Claims, 4 Drawing Sheets

BRISTLE HOLDER FOR A BRUSH

CROSS REFERENCE TO RELATED APPLICATIONS

This application is a continuation of prior co-pending International Application No. PCT/IB2010/051446 filed Apr. 1, 2010, designating the United States.

FIELD OF THE INVENTION

The present invention relates to a bristle holder and a brush having such a bristle holder. The brushes described are particularly suitable as hair brushes.

BACKGROUND OF THE INVENTION

Conventional brushes comprise a handle part, which is usually formed from one piece and leads to a shaft part or other bristle holding part, and in which the bristles are anchored. In such brushes, there are generally few problems when connecting bristle holder and handle part with one another.

The service life of the brush is typically determined by its bristles and their condition. Thus, when the bristles no longer have the desired condition, it is necessary to replace the entire brush.

US patent 2005051187A discloses a brush having a replaceable bristle set. The bristle set is held in place in the brush by a frame. While this may guarantee the bristle set to be situated securely, it is necessary to handle three parts when replacing parts.

British patent GB 330,573 discloses an elaborate brush having a replaceable bristle set. The bristle set is held in place at the edges. Because significant forces are at work during brushing, particularly when brushing long hair, it is possible that this mounting is not stable enough to securely hold the bristle set.

German published patent application DE 26 51 730 discloses a hot air device having a replaceable brush insert. The insert is shaped like a calotte of elastic material, for example, rubber. The calotte can be connected to the hot air part by means of rubber studs. In the eyes of many consumers, this solution does not appear to securely connect both parts to form one unit.

Potential manufacturing defects or ridges on the replaceable rubber part, most often in a cheaply produced "disposable" part, remain visible.

It is especially those brushes having an additional use, for example in the form of hot air or also an ion source, that are generally expensive. It is therefore desirable to be able to switch the bristle part, but to continue using the rest of the brush. Even after switching parts, the bristles are to remain firmly held in the brush. Differences in the parts, potentially caused by manufacturing tolerances, should therefore also not play a significant role.

The present invention aims to avoid the disadvantages described in the prior art. To that end, a bristle holder and a brush are to be provided, which can be connected with one another in a stable manner and which can nonetheless be easily switched. When connected, both parts are to form an aesthetically pleasing whole.

SUMMARY OF THE INVENTION

The present invention relates to a brush and a bristle holder. The invention relates in particular to a bristle holder for a brush, the bristle holder having a frame, a bristle anchoring means, and a back part, the back part having a first end area adjacent to the handle part of a connectable brush and a second end area adjacent to the brush end, the first end area supporting at least one first connecting element and the second end area supporting at least one positioning element and at least one holding element. The invention furthermore relates to a brush with and for a bristle holder of the described type.

DETAILED DESCRIPTION OF THE INVENTION

A bristle holder according to the invention thus comprises in particular a bristle anchoring means, a back part, and a frame. The back part, for example, can be an essentially flat plate. Towards the bristles, a circumferential frame can project at this back part. A bristle anchoring means can be clamped into this frame. A suitable bristle anchoring means, for example, consists of a bristle supporting mat. The bristle anchoring means supports bristles. Individual bristles can be embedded through holes into a bristle supporting mat, for example, and the bristles can be fixed on the back of the supporting mat by means of suitable thickened parts or by other means.

The back part of the bristle holder has two end areas. When the bristle holder is connected with the brush, the first end area is adjacent to the handle part of the brush, and the second end area is adjacent to the brush end. The end areas can encompass a significant part of the back part and, in individual cases, can even extend as far as the middle of the back part. However, the end areas are preferably limited to smaller areas of the back part, approximately the outer third in each case. According to the invention, the first end area should support at least one connecting element. All suitable elements can be considered as connecting elements, in particular mechanical elements, which offer a connection that can be detached and reattached repeatedly. Suitable are, for example, mechanical elements, which are able to engage a male or female connecting element with a corresponding female or male connecting element. Suitable are, for example, hooks, which engage an undercut.

According to the invention, the second end area has at least one positioning element and at least one holding element. A positioning element is understood to be an element, which limits the position of the bristle holder relative to the brush in at least one dimension. The position of the bristle holder should in particular be arranged to be horizontal, in line with the plane of the back part. All suitable mechanical elements can be considered here as well, in particular also those providing a male element or a female element for engaging with a corresponding female or male element. A suitable positioning element, for example, is a spur, which can engage a recess and whose position is thereby determined.

The second end area further supports at least one holding element. These holding elements can also be selected from a plurality of elements, in particular mechanical elements. The holding element is to hold the bristle holder to the brush in a predetermined position, for example, in cooperation with a suitable receiving means. A suitable holding element, for example, is a clip or a snap-in hook. Contrary to the positioning elements, the holding element only determines the position of the bristle holder relative to the brush to a limited degree. In particular, a typical holding element in the plane of the back part can ensure some play for the bristle holder. However, the holding element will prevent the separation of bristle holder and brush.

The back part of the embodiment of the invention has four areas. These four areas divide the back part into four longitudinal sections of equal length. In this, the first area is adjacent to the handle part, the second area borders thereto, the third area borders the second area, and the fourth area borders the third area and is adjacent to the brush end. Of these areas, the first area should support at least two connecting elements. The third area should support at least one positioning element and the fourth area at least one holding element. The areas can be free of other elements, the second area in particular can be entirely free of connecting, holding, or positioning elements. It has been shown that this arrangement makes switching the bristle holder especially easy, while it simultaneously assures a strong connection between bristle holder and brush.

In an arrangement, the first area supports two connecting to elements. The third area supports two positioning elements and the fourth area one holding element. This arrangement is again especially favorable for guiding the bristle holder in a stable manner and removing it easily. This arrangement is furthermore also especially favorable for the method of inserting a bristle holder into a brush.

Similar advantages can be achieved in a favorable manner according to another embodiment of the bristle holder. At least relative to its back part, the bristle holder has a longitudinal axis, in relation to which it or at least the back part is symmetrical. The first connecting element or the two or more first connecting elements can be positioned symmetrically in relation to this longitudinal axis; likewise the holding element. If only one connecting element and one holding element are used, they are centered on the longitudinal axis. Duplicate elements, typically the positioning elements, are symmetrically arranged to the left and right of the longitudinal axis.

According to another embodiment, the first connecting element(s) is (are) designed as a hook (hooks). Particularly suitable are rigid, non-elastic hooks.

Arcuate or even circular arcuate hooks are especially favorable. During use, the hook shape can anticipate the typical directional movement of the bristle holder relative to the brush.

The brush itself is also an important part of the invention. Particularly inventive is a brush having a bristle holder of the type described thus far. The brush should be designed for the bristle holder. Advantageously, the brush has a handle part and a connecting surface for a bristle holder that is connected with the handle part. In this, the connecting surface need not be flat, but can also have projections or recesses as well as a number of connecting, positioning, and holding elements or receiving means. Particularly at its edges, the connecting surface can bulge or have a protruding frame.

According to another embodiment, the connecting surface has at least one second connecting element, which is designed to receive at least one connecting element. Thus, it is in particular also possible to design the one second connecting element such that it is suitable for receiving two first connecting elements.

According to this embodiment, the connecting surface furthermore has at least one recess for receiving the positioning element(s). The number of recesses should generally correspond to the number of positioning elements; much as the shape of the recesses should be designed such that the positioning elements are received or at least guided in an essentially form-fitting manner. The connecting surface can furthermore have a receiving element for the holding element.

According to another embodiment, the second connecting element is designed as a depression having a projection. Such a projection can be an undercut, and the two first connecting elements can engage with this projection or undercut, for example, when they are designed as hooks.

In one favorable embodiment, the second connecting element has a center guiding means for first connecting elements. A protruding stud can be considered, for example. A first connecting element can then be guided on one side of the stud and another connecting element on the other side of the stud. This leads to the bristle holder being securely guided into its final position when making the connection with the brush.

Useful connecting elements, i.e., first and correspondingly matching second connecting elements, will protect the bristle holder against both vertical extraction from the brush as well as horizontal shifting in the plane of the back part. By contrast, the holding element will often allow some play for the bristle holder in the plane of the back part—however, only when considered in isolation. In general, this play is entirely suppressed by the positioning element and corresponding recesses of both the first and second connecting elements.

An ejecting element is also useful. This ejecting element can be encompassed by the connecting surface of the brush. The ejecting element can comprise a leaf spring, for example. Opposite the leaf spring, a spur can be affixed to the back part of the bristle holder. This spur can then push against the leaf spring. The brush can furthermore comprise an eject button, which acts upon the holding element or the receiving element for the holding element. For example, such a triggering button can be provided in the end area of the brush, which moves the receiving element for the holding element and thus releases the holding element. By means of the spur that is resiliently pretensioned against the ejecting element, the to bristle holder is then moved away from the connecting surface. The positioning elements easily release the bristle holder vertical to the connecting surface. This construction thus facilitates convenient ejecting of the bristle part.

One embodiment of the invention also takes into consideration that an electric connection can be established between a leaf spring or another element of the ejecting element and the corresponding spur. Such a connection can be used, for example, for grounding the bristle field if a contact is established between the spur and the bristle field or a part of the bristle holder adjacent to the bristle field. Such grounding can be of interest if the brush comprises an ion source.

Advantageous is also a brush in which the connecting surface has and is typically surrounded by a frame, which encompasses the frame of the bristle holder. Because it is a replacement part, the bristle holder is often not manufactured quite as costly as the handle part of the brush itself. Therefore, it is for instance possible that the edge of the bristle holder shows irregularities at its back part or particularly at its frame. In plastic parts, these may be ridges, for example. Such irregularity can be completely covered by surrounding the sides of the bristle part with an outer circumferential frame.

A method for using a bristle holder in a brush is also disclosed according to the invention. In such a method, the first end area of the bristle holder should be initially supported at one area of the connecting surface adjacent to the handle part. By means of this first support, the bristle holder can be guided especially easily and precisely. Then, an at least partial connection between the at least one first connecting element and the at least one second connecting element is initially created. Such an at least partial connection can be established, for example, between hooks that are encompassed by the first connecting element and a center guiding means that is provided by the second connecting element. In a further method step, the at least one positioning element is then positioned relative to its receiving means in the at least one recess. Later, an additional connection can be established between the holding element and its receiving means. It has been shown that this method makes a very simple but nonetheless precise connection between bristle holder and brush possible.

DESCRIPTION OF THE FIGURES

The figures, described in more detail below, provide better understanding of the invention. Insofar as it is technically feasible, features disclosed in the different figures can also be combined with one another.

FIG. 1 shows a schematic view of the brush 10 from the bristle side. On the bottom, the handle part 200 is shown. It can be designed to have any shape that can be comfortably held. Opposite the handle part 200 is the brush end 12 of the brush 10. Between the handle part and the brush end 10 is the bristle holder 100, which supports a plurality of bristles 112.

FIG. 2 shows the back part 130 of the bristle holder 100. The back part is opposite the bristle side. The back part has a first end area 131, which is adjacent to the handle part 200 (not shown). Situated opposite to this first end area is the second end area 132, which borders the brush end 12 (also not shown). The back part 130 is enclosed by a circumferential frame 120. The back part is symmetrical in relation to the longitudinal axis L. More precisely, it can be divided into four areas, all of which have the same length along the longitudinal axis L. Again adjacent to the not shown handle part 200, the back part 130 has a first area 133. This is bordered by a second area 134 and a third area 135. Bordering the third area 135 is a fourth area 136, which is situated in the vicinity of the brush end 12. The first area 133 has two first connecting elements 140 and 142. These are positioned symmetrical in relation to the longitudinal axis. The second area is free of connecting, holding, or positioning elements. The third area 135 has two positioning elements, positioning element 144 and positioning element 146. The fourth area 136 has a holding element 148. The holding element is centered on the longitudinal axis. As an additional element, the fourth area 136 has a spur 150, which is also centered on the longitudinal axis. If the back part 130 is not divided into four areas, but rather only into a first end area 131 and a second end area 132, the position of the elements can be described as follows: The first area 131 has the two first connecting elements 140 and 142. The second end area 132 has the positioning elements 144 and 146, and also the holding element 148 and the spur 150.

FIG. 3 shows a schematic side view of the back part 130. The first area 133 has a hook 152. It represents an embodiment of a first connecting element such as, for example, the connecting element 142. The hook is designed to be circular arcuate. It can be made of rigid, non-elastic material. With it, it is possible to engage an undercut, for example. Due to its circular arcuate shape, it can be easily moved in a circular arcuate direction to engage with the undercut. The second area 134 is again free of all elements. The bordering third area 135 has a positioning element 146 in the shape of a truncated cone. This is initially followed by a spur 150 in the fourth area 136. Advantageously, this can have the shape of a truncated pyramid, for example. Then follows another hook 154, which represents an embodiment of a holding element. The hook can be designed as a snap-in hook having an elastic shaft.

FIG. 4 shows a schematic view of brush parts when the bristle holder is detached. It shows the handle part 200 as well as the connecting surface 210 adjacent to it. A frame 220, which is only schematically indicated, encompasses this connecting surface. This frame may project beyond the connecting surface. The connecting surface 210 has a second connecting element 240. It is designed as a depression, which may be able to receive one or two first connecting elements. The depression has an undercut 241, with which first connecting elements can engage. The second connecting element 240 furthermore has a center guiding means 242. When two first connecting elements are to be connected with the second connecting element 240, they can be positioned to the left and right of the center guiding means 242. This results in a secure connection and ensures helpful guidance when inserting the bristle holder 100 into the brush 10. The connecting surface 210 furthermore has a recess 244 and a recess 246 for receiving corresponding positioning elements. These recesses may, for example, also project into the surface as a truncated cone. Provided above the recesses is a holding means 248 for the holding element 148. If the holding element 148 is designed as a hook, for instance, then the holding means 248 can have a projection or an additional hook. It is in particular possible that the corresponding projection or hook is resiliently mounted and can be shifted with the aid of the pushbutton 252 in such a way that it releases the holding element 148. On the connecting surface 210, an ejecting element 250 is furthermore provided. This ejecting element 250 can have a resilient element such as, for to example, a leaf spring. If the spur 150 is pressed against the leaf spring of the ejecting element 250, the bristle holder 100 rests resiliently pretensioned on the connecting surface 210. Depressing the pushbutton 252, which releases the holding means 248, causes the resilient release of the bristle holder from the brush 10.

Figure 1:
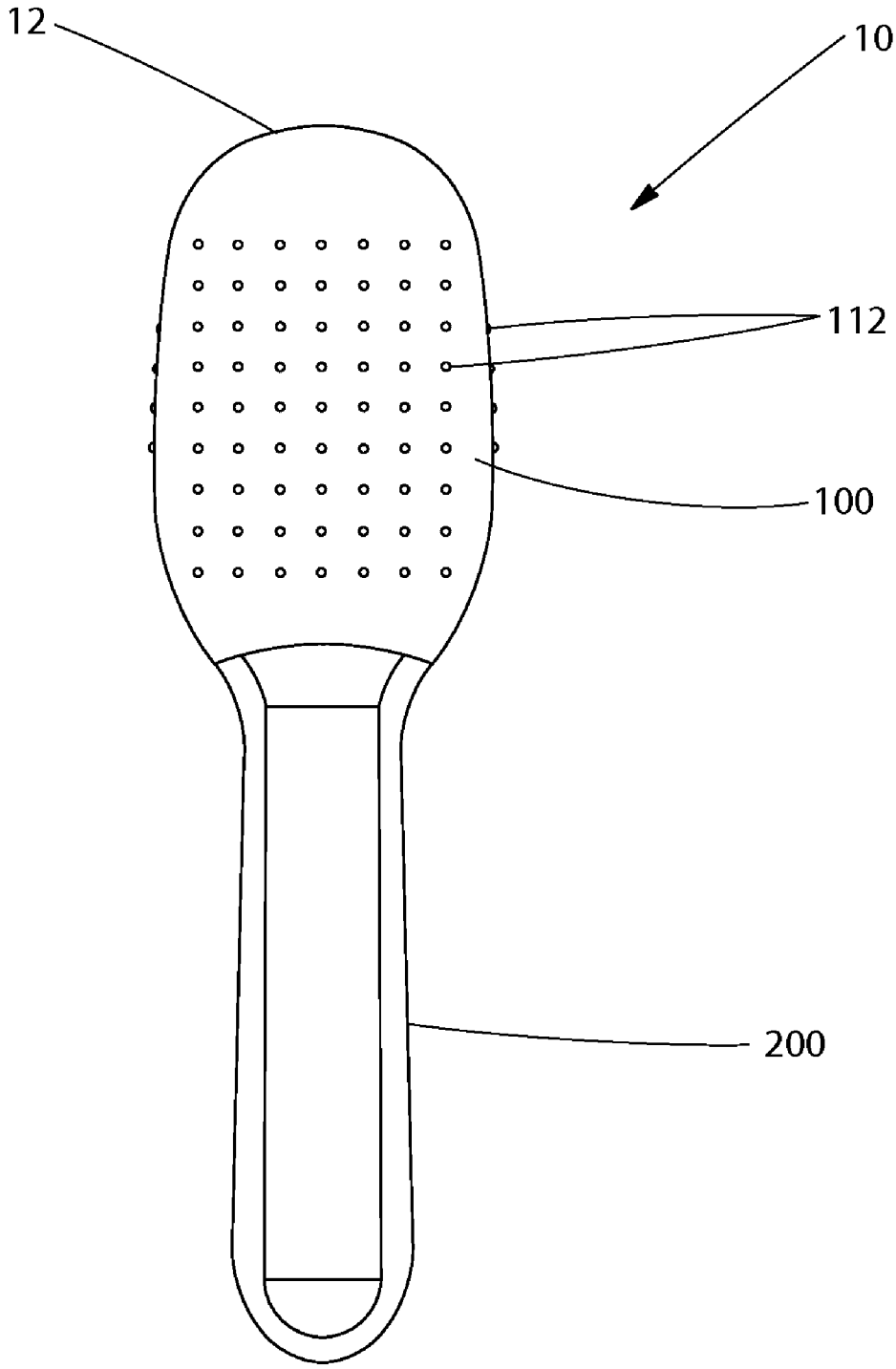
FIG. 1 shows a schematic top view of the brush from the bristle side.
Figure 2:
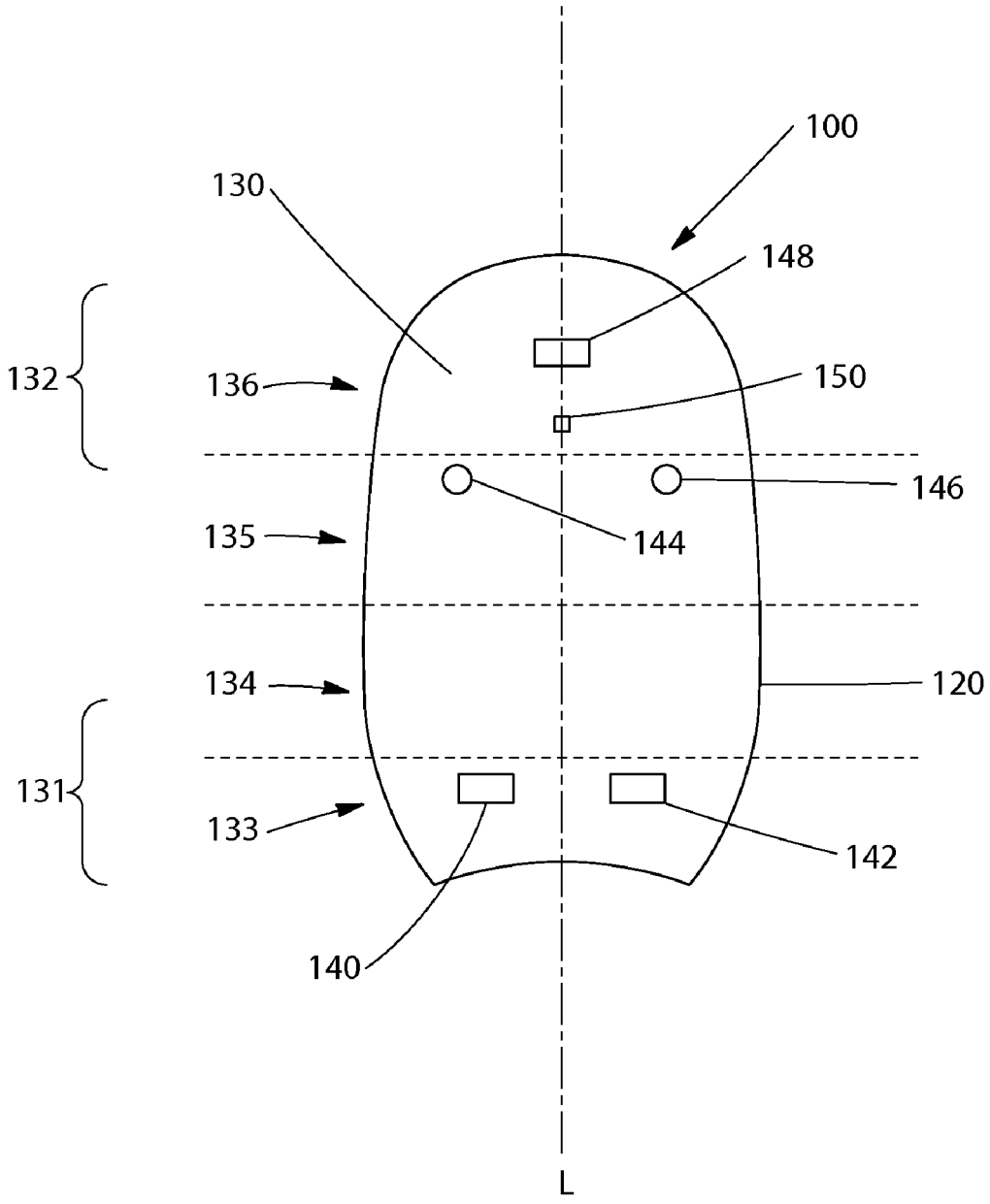
FIG. 2 shows a schematic view of the back part of the bristle holder.
Figure 3:
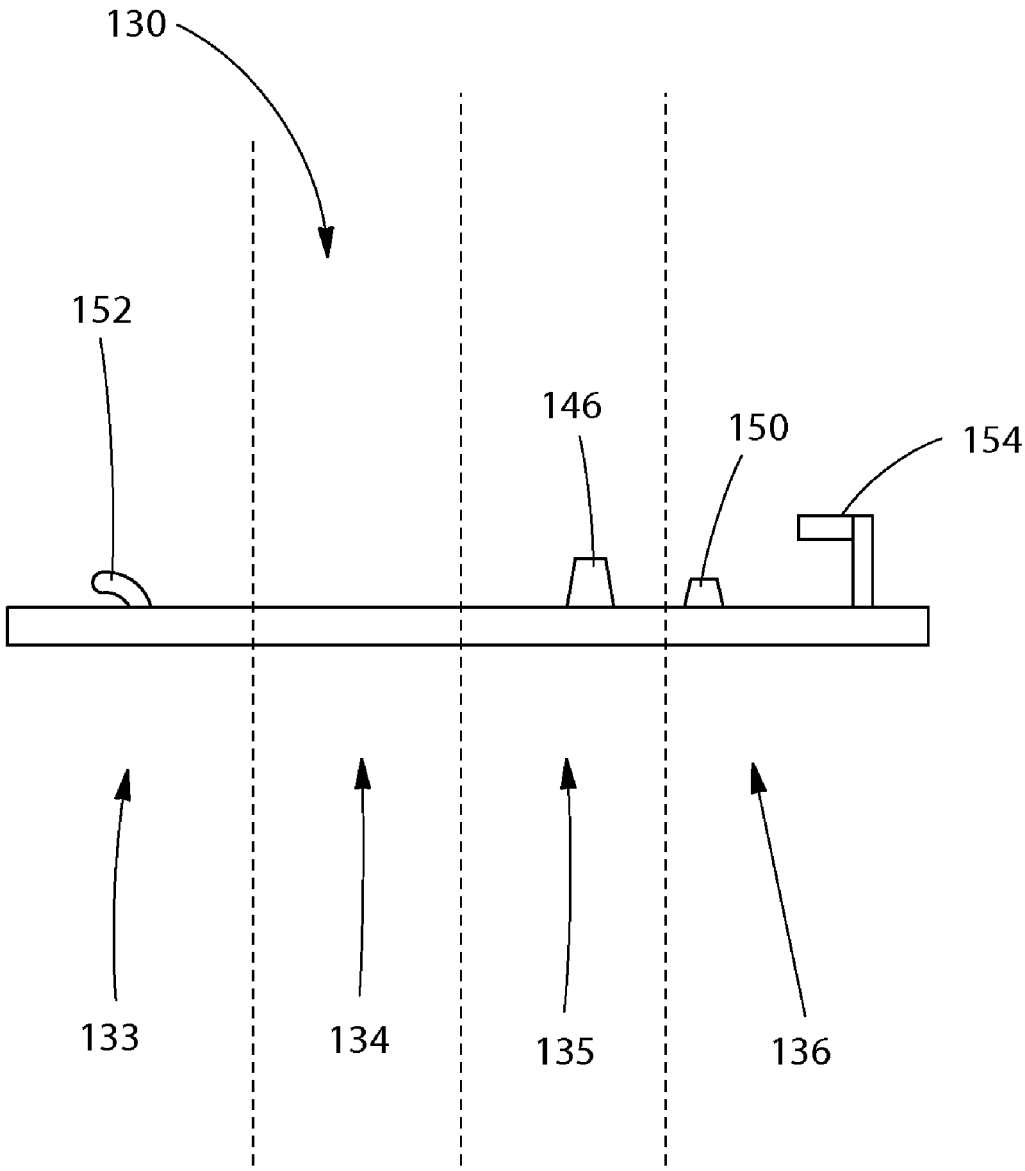
FIG. 3 shows a schematic side view of the back part of the bristle holder.
Figure 4:
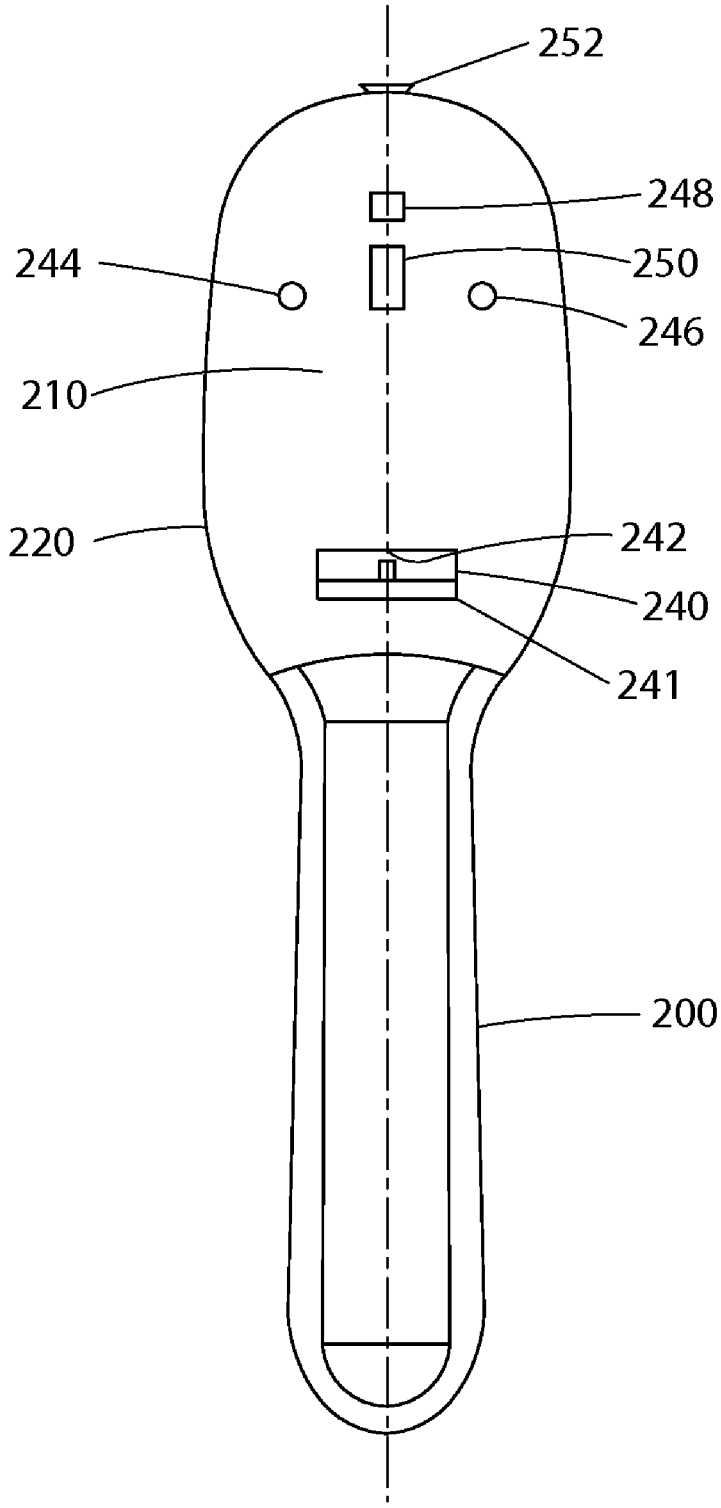
FIG. 4 shows a schematic view of the brush without the bristle carrier.

The specification shows how an easy to create an easy to release connection between bristle holder and brush can be created overall. This connection is not susceptible to manufacturing tolerances, but does withstand the considerable forces working on the bristle field and the brush during brushing.

What is claimed is:

1. A bristle holder (100) for a brush (10), comprising bristles (112), the bristle holder (100) having a frame (120), and a back part (130), the back part (130) having a first end area (131) that is adjacent to the handle part (200) of a connectable brush and a second end area (132) adjacent to the brush end, the first end area (131) supporting at least one first connecting element (140) and the second end area (132) supporting at least one positioning element (144) and at least one holding element (148), wherein:

(i.) said back part has a first area adjacent to the handle part, bordering thereto a second area, bordering thereto a third area, and bordering thereto a fourth area that is adjacent to the brush end, the first, second, third, and fourth area of the back part being divided into four longitudinal sections of equal length, the first area supporting two said first connecting elements and the third area supporting two said positioning elements and the fourth area supporting one said holding element;

(ii.) wherein said, back part is symmetrical in relation to a longitudinal axis (L), and the holding element is centered on this longitudinal axis, and the first connecting elements and the positioning elements are arranged symmetrically in relation to this longitudinal axis;

(iii.) wherein the first connecting elements comprise hooks; and (iv.) wherein the hooks are essentially arcuate.

2. A brush having a bristle holder according claim 1.

3. The brush according to claim 2, having a handle part and a connecting surface connected to a handle part for a bristle holder.

4. The brush according to claim 3, in which the connecting surface has at least one second connecting element, which is designed to receive at least one first connecting element and furthermore at least one recess for receiving the positioning elements and furthermore one receiving means for the holding element.

5. The brush according to claim 4 wherein the second connecting element is a depression having a projection for receiving the two first connecting elements.

6. The brush according to claim 5, in which the second connecting element has a center guiding means for the first connecting elements.

7. The brush according to claim 3 wherein the connecting surface of the brush comprises an ejecting element.

8. The brush according to claim 3 wherein an electrical contact can be established between the connecting surface and the back part of the bristle holder.

9. The brush according to claim 3 wherein the connecting surface has a frame that encompasses the frame of the bristle holder.

* * * * *